US006216613B1

(12) United States Patent
Wachendorfer

(10) Patent No.: US 6,216,613 B1
(45) Date of Patent: Apr. 17, 2001

(54) COMBUSTION PROCESS

(75) Inventor: Paul Wachendorfer, Carrollton, OH (US)

(73) Assignee: Theoretical Thermionics, Inc., McDonald, OH (US)

( * ) Notice: Subject to any disclaimer, the term of this patent is extended or adjusted under 35 U.S.C. 154(b) by 0 days.

(21) Appl. No.: 09/348,128

(22) Filed: Jul. 2, 1999

Related U.S. Application Data

(62) Division of application No. 08/897,939, filed on Jul. 21, 1997.

(51) Int. Cl.[7] ..... F23B 7/00

(52) U.S. Cl. ..... 110/347; 110/262; 110/263; 110/342

(58) Field of Search ..... 110/104 B, 260, 110/261, 262, 263, 264, 265, 266, 346, 347, 322, 323, 342

(56) References Cited

U.S. PATENT DOCUMENTS 792,667 * 6/1905 Rogers ..... 110/347 X
1,560,076 * 11/1925 Gates ..... 110/347
1,969,501 * 8/1934 Chapman ..... 110/263
3,085,865 * 4/1963 Long et al. ..... 110/261 X
4,574,711 * 3/1986 Christian ..... 110/264
4,597,342 * 7/1986 Green et al. ..... 110/347

* cited by examiner

*Primary Examiner*—Ira S. Lazarus
*Assistant Examiner*—Ljiljana V. Ciric
(74) *Attorney, Agent, or Firm*—Watts, Hoffmann, Fisher & Heinke Co.

(57) ABSTRACT

A process for solid fossil fuel oxidation that utilizes a refractory that defines a reactor core and a combustor chamber in serial communication. The reactor core is heated by burning an air fuel mixture external to the reactor core. A non-oxidizing gas/coal mixture is introduced into the reactor core where heat energy is transferred to the non-oxidizing gas/coal mixture so that the specific heat of the mixture is substantially raised. The non-oxidizing gas/coal mixture is discharged from the reactor core into the combustor chamber at which point an oxidizing medium such as air is introduced in order to instantly oxidize the heated non-oxidizing gas/coal mixture. The non-oxidizing gas may be a flammable gas, such as methane.

3 Claims, 4 Drawing Sheets

COMBUSTION PROCESS

This is a Divisional application of application Ser. No. 08/897,939, filed on Jul. 21, 1997.

FIELD OF THE INVENTION

The present invention relates generally to a coal combustor and, more specifically, will be referred to as an entropic reactor for the combustion of coal in fossil burning plants, such as utility plants.

BACKGROUND ART

Most fossil burning plants, such as utility plants, presently utilize a burning or firing combustion process in which most of the thermochemical reaction takes place beyond the burner duct port in the furnace work chamber. Further oxidation of the unburned fuel particles exiting the burner is termed "residual-combustion" and equates to a degree of inefficiency. The negative resultant aspects following initial combustion in the burner effects the reformulation of unburned hydrocarbons having a higher ratio of carbon to hydrogen, an added detriment to the further completion of combustion. In order to finalize combustion, excessive amounts of combustion air must be introduced into the work chamber and various methods of under/over firing with gaseous fuels must be utilized to effect "reburn." This results in over-voluminous, inefficient and high cost boiler structures.

Past attempts by various firms knowledgeable in the art of thermochemical combustion to develop a combustor designed to complete all oxidizing rate-reactions have failed. During the 1980s the DOE funded millions of dollars to such projects. Operationally, the then designed combustors thermochemically failed to totally oxidize the carbonic elements. This resulted in a graphitic "char" formation causing clogging and eventual shutdown of the process.

Present firing combustion processes also exhibit post combustion problems which adversely affect the environment. Pollutants formed by sulfurous compounds and nitrous oxides and particulates, unless treated by expensive control systems, typically result from presently utilized combustion processes. A more advanced thermotechnical method for the oxidative combustion of hydrocarbons is desirable in order to eliminate or reduce problems associated with these pollutants.

DISCLOSURE OF THE INVENTION

The present invention provides a new and improved thermotechnology for the design of a combustor for use in, for example, steam generation in the boiler of a utility power plant. The disclosed Entropic Reactor-Combustor (ER-C) structure includes a reactor chamber, combustion chamber, and discharge chamber serially connected along a central axis.

In one preferred embodiment, the structure is formed as a single-cell entropic-reactor combustor (ER-C). In this embodiment, each chamber is made of a high temperature and corrosion resistant material such as a refractory/ceramic material. These refractory chambers define, respectively, a reactor zone, combustion zone, and discharge zone that extend through the refractory.

According to an illustrated embodiment of the invention, the combustion chamber comprises a venturi and the discharge chamber comprises a diverging nozzle. The single-cell ER-C includes a ceramic baffle insert that is concentrically disposed within the forward end of the reactor chamber. According to the invention, the baffle defines at least one coal-gas passage extending longitudinally through the baffle and includes means for communicating an air-fuel mixture to the reactor zone. A reactor core tube, made of a refractory material, is sealingly engaged by the baffle. The core of the tube is in fluid communication with the coal-gas passage. The tube extends longitudinally through a portion of the reactor zone and terminates into the combustion zone. The reactor core tube communicates a coal-gas mixture from the coal-gas passage to the combustion zone. Means are provided for burning the air-fuel mixture in the reactor zone thereby heating the reactor core tube. The coal-gas mixture passing through the reactor core tube is thereby heated by conduction through the tube before entry into the combustion zone.

By irradiating the coal-gas mixture with heat energy the volumetric specific heat of the mixture is substantially raised. It is believed that this irradiation (which may be termed photolytic irradiation) ionizes the coal molecule and causes a debonding of its molecular structure. A molecular reformation of the coal and gas takes place that creates a new fuel mixture before the mixture is discharged from the reactor core tube. This restructuring of the coal-gas mixture effects a more effective and efficient burning upon combustion in the combustion chamber so that carbon by-products or graphitic build-up in the work chamber is substantially reduced or eliminated.

According to a feature of the invention, the air fuel mixture is communicated by means of an array of fuel burner ducts spaced from and disposed around the coal-gas passage, and extending longitudinally through the ceramic baffle insert. Disposed around each fuel burner duct is an array of air supply ducts extending longitudinally through the ceramic baffle insert.

According to another feature of the invention, the combustion chamber includes a plurality combustion air supply pipes extending radially through the chamber and terminating into the combustion zone. The air supply pipes are equally spaced apart around the periphery of the combustion chamber. There are an even quantity of air supply pipes so that any pipe in the array is diagonally opposed from another pipe in the array.

In another preferred embodiment, the entropic reactor combustor (ER-C) comprises a plurality of cells that are used to achieve the desired amount of volumetric specific heat. The design of the reactor chamber is based on an array of planetarily positioned unitized cells. The reactor chamber comprises a ceramic baffle in concentric relation to the reactor core chamber. Extending longitudinally through the baffle, and spaced a distance from the reactor core center, is a first array of integrated ceramic entropic fuel tubes, or ducts, disposed on a first inner radius and a second array of relatively larger ceramic tubes, or ducts, disposed on a larger second radius. Interposed between the first and second radially disposed ducts is an array of corresponding cavity ducts, or gaps, which form a series of interspacial reactor core cells, or a continuous planetary circumferential reactor chamber.

A fuel mixture, such as pulverized coal and methane gas, is dispensed into the interspacial reactor core chamber cells through a series of pulverized coal/gas supply nozzles attached to the ends of the reactor core chamber cells. An entropic fuel, such as methane gas, and combustion air are combined in the first and second array of entropic fuel ducts through a series of air/gas mix supply nozzles attached to the ends of the tubes. The air/gas mixture, when burned in the multiple series of entropic fuel ducts, generates intense heat required for conductivity through the walls of the entropic fuel ducts enclosing the interspacial reactor core chamber. The conducted source of continuous heat from the outer surface of the reactor core chamber is radiated to the inner surface of the reactor core to heat the pulverized coal/gas fuel mixture during passage through the reactor core chamber.

It is believed that in the disclosed apparatus the pulverized coal particles are initially subject to a sufficiently powerful thermalytically induced radiation to degratively decompose the molecular structure of the pulverized coal particles. The thermalytic process maximizes the entropy, and therefore, increases the internal electrostatic energy of the coal molecule. During further passage through the interspacial reactor core chamber the irradative exposure causes critical phase changes, promoting a vaporous/gaseous state. Concurrently, additional rapid operatives promoted by ionization and radicalization of the coal molecules effect requisite molecular reformations critical to subsequent detonative-oxidation of all carbonic elements of the coal particle in the downstream ER-C combustion chamber.

Unlike presently utilized conventional flame combustion devices or coal-firing systems, the ER-C thermal technology maximizes thermoflux and specific heats beyond the capability and efficiency of any existing flame syndrome burner. It is believed that, unlike existing industrial or utility power plants having lengthy time sequences for burning fuels by flame combustion, the ER-C process develops improved thermal efficiencies at lower costs. The ER-C substantially averts the problems involving the formation of flame cores resulting from reformed hydrocarbons having a higher ratio of carbon to hydrogen. Flame cores typically result in an undesirable graphitic phase blocking char formation. The high temperature reactions developed by the ER-C act to vaporize the inclusive inert minerals and promote further chemisms to atomize any potentially present tars/chars to a gaseous state.

According to another feature of the invention, the ER-C, when utilized with catalytic additives, can convert pollutant by-products, such as sulfur compounds and nitrous oxides into inert, stable compounds. Consequently, the post combustion and stack emissions control costs born by fossil burning plants operated by coal firing may be substantially reduced.

According to yet another feature of the invention, insulation is disposed around the periphery of the refractory material.

Additional features of the invention will become apparent and a fuller understanding obtained by reading the following detailed description made in connection with the accompanying drawings.

BEST MODE FOR PRACTICING THE INVENTION

Figure 1:
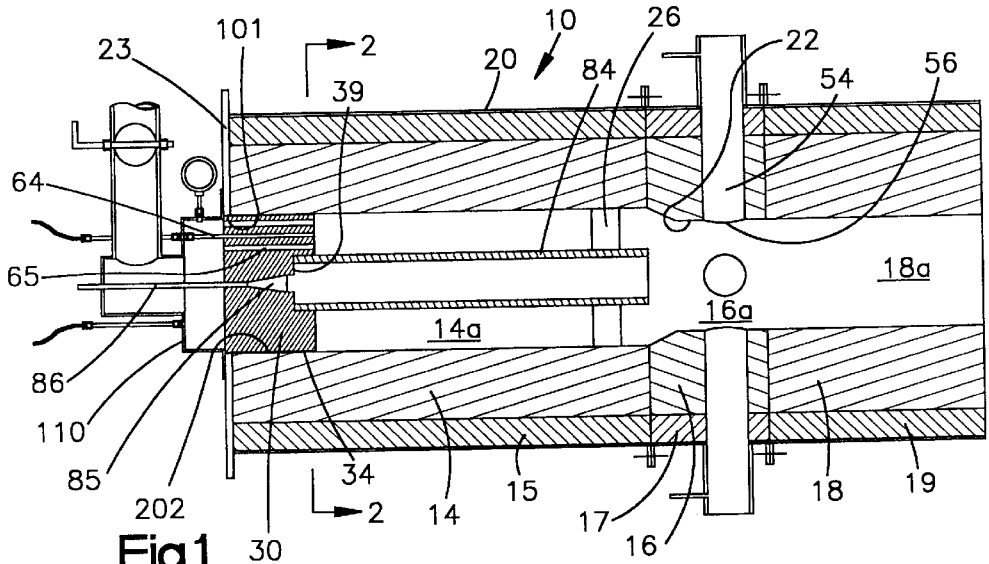
FIG. 1 is a section elevational view of a single cell entropic reactor combustor showing reactor, combustion, and discharge zones.
Figure 2:
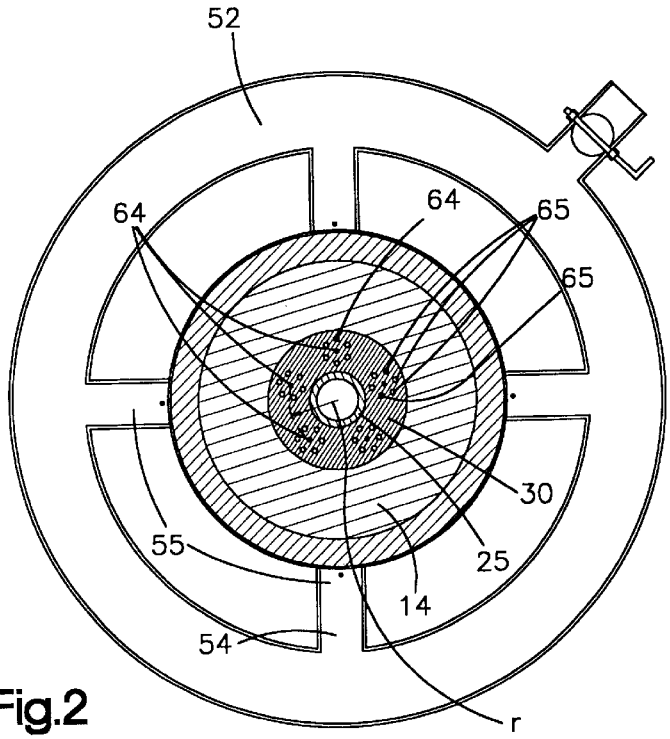
FIG. 2 is a section view of the FIG. 1 single cell entropic reactor combustor as seen from the plane 22 in FIG. 1 showing an array of air and fuel ducts.
Figure 3:
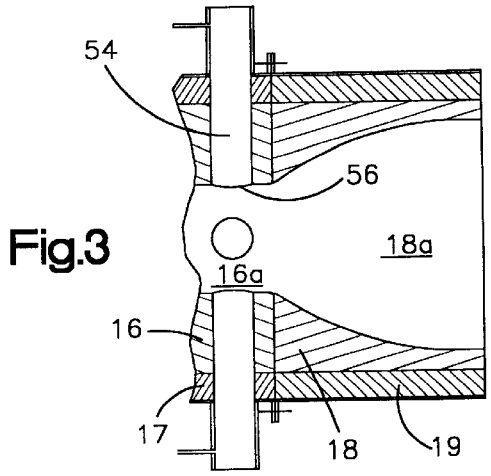
FIG. 3 is a broken section elevational view of an alternative embodiment of the single cell entropic reactor combustor showing a diverging discharge nozzle.

FIGS. 1 through 3 illustrate the overall construction of a "single-cell" Entropic Reactor Combustor (single-cell ER-C) 10. As shown in FIG. 2, the single-cell ER-C 10 includes a reactor chamber refractory 14, combustion chamber refractory 16, and discharge chamber refractory 18 connected in series and defining, respectively, a reactor chamber zone 14*a*, combustion chamber zone 16*a* and discharge chamber zone 18*a*. The combustion chamber refractory 16 includes a venturi passage defined by an inner wall 22 of the combustion chamber refractory 16. As shown in FIGS. 2 and 3, the discharge chamber zone 18*a* may comprise a uniform cylindrical chamber or a diverging nozzle. Disposed around the periphery of each refractory chamber 14, 16, 18, is a high temperature insulation material 15, 17, 19, respectively, and a combustor support housing 20 connected to a end plate flange 23. In concentric relation to the three chambers 14, 16, 18 is a ceramic baffle insert 30 which extends through an opening 101 in the end plate flange 23 and a reactor core tube 84. An outer wall 34 of the ceramic baffle insert 30 sealingly engages the forward end of an inner wall 202 of the reactor chamber 14. The reactor core tube 84 extends substantially the length of the reactor chamber zone 14*a* whereby one end of the reactor core tube 84 is sealingly engaged by a recess 39 in the ceramic baffle insert 30 and the other end is supported by a ceramic tube support 26 and terminates into the combustion chamber zone 16*a* of the single-cell ER-C 10.

As shown in FIGS. 1 and 2 of the disclosed embodiment, the ceramic baffle insert 30 defines an array of entropic fuel burner ducts or pipes 64 and an array of air supply ducts 65 that are disposed around each fuel burner duct 64. The fuel burner ducts 64 and air supply ducts 65 extend longitudinally through the ceramic baffle insert 30 and terminate into the reactor chamber zone 14*a* (as shown in FIG. 1). In the disclosed embodiment, there are five equally spaced fuel burner pipes 64 disposed on a radius r, and six equally spaced air supply ducts 65 surrounding each fuel burner pipe 64.

A flanged combustion air chamber 110 is mounted to the end plate flange 23 by a plurality of fasteners or welds. The air chamber 110 allows combustion air to enter each air supply duct 65 at substantially the same volumetric flow rate and pressure. The fuel burner pipes 64 extend rearwardly through the air chamber 110 and are connected to an external entropic fuel supply source (not shown). Conventional sealing methods can be used to seal the interface between the fuel burner ducts 64 and the air chamber 110.

In the disclosed embodiment, an entropic fuel, such as methane, and combustion air are entrained to burners and the products of combustion are routed through the reactor chamber zone 14*a*. Conventional fuel burners (not shown) initiate and maintain the necessary pyrolytics for the supply of heat to the reactor core tube 84. The burning of the entropic fuel in the reactor chamber zone 14*a* generates intense pyrolytic source heat for conduction through the wall of the reactor core tube 84.

The ceramic baffle insert 30 further defines a pulverized coal/gas supply nozzle 85 which is in fluid communication with the reactor core tube 84 and a pulverized coal/gas supply passage 86 connected to an external coal/gas flow control source (not shown). According to the invention, a gas, such as methane, and pulverized coal particles are dispensed into the reactor-core tube 84 through the pulverized coal/gas supply nozzle 85.

The reactor chamber 14 acts as a molecular reactor. The intense heat from the burning methane/air mixture in the reactor chamber zone 14*a* pyrolytically heats the reactor core tube 84. The heated reactor core tube 84, in turn, photolytically heats the pulverized coal/gas fuel mixture flowing through the reactor core 84. In effect, the chemisms that take place in the reactor core 84 radicalize the methane gas and pulverized coal. The coal particles and gas are irradiated with high energy photons within the reactor core tube 84, thereby substantially raising the specific heat of the coal/gas fuel mixture. The photons reach an energy equal to or higher than that of an electron, which causes electrons to be continually emitted. It is believed that this photolytic irradiation ionizes, or degradates, the coal molecule, and causes a debonding of its molecular structure. The gas has a hydrogenolysis effect on the pulverized coal. In other words, two hydrogen atoms are freed from the methane gas molecule, and carbon atoms from the pulverized coal bond to these two freed hydrogen atoms. For this reason, it is necessary that the gas have a sufficient amount of hydrogen to degradate the coal molecule. The gas selected should preferably have a high hydrogen to carbon ratio as in, for example, methane gas ($CH_4$). It is also believed that sublimation takes place during passage of the pulverized coal/gas fuel mixture through the reactor core tube 84; that is, the irradative exposure causes a phase change in the pulverized coal/gas fuel mixture to a vaporous/gaseous state. The new fuel comprises a new group of combustible chemisms that is in the form of a vapor upon discharge from the reactor chamber 14.

Upon entry into the combustion chamber zone 16*a*, the new fuel undergoes detonative oxidation combustion. In the preferred and illustrated embodiment, the oxidizing media used to oxidize the new fuel flows perpendicular to the path of the new fuel. As shown in FIGS. 1 and 2, a plurality of combustion air supply pipes 54 extend radially inward through the combustion chamber refractory 16 and terminate into the combustion chamber zone 16*a* via respective air inlet openings 56 defined by the inside wall 22 of the combustion chamber refractory 16. The air supply pipes 54 are in communication with a combustion air manifold 52 connected to a combustion air supply source (not shown). In the disclosed embodiment, the air supply pipes 54 are equally spaced apart to form a planetary spoked pattern 55. The air supply pipes 54 are positioned so that the flow of combustion air into the combustion chamber zone 16*a* is perpendicular to the flow of the pulverized coal/gas fuel mixture discharged from the reactor core tube 84. As shown in FIG. 1, an even amount of air supply pipes 54 is preferably used so that flow from one air supply pipe 54 collides with flow from its opposing air supply pipe 54. It is believed that the use of counterflow directed air supply pipes 54 facilitates turbulence in the combustion chamber zone 16*a* and substantially promotes uniform and instant exposure of the surface areas of coal particles to oxidative rate reactions.

The present invention provides significant advantages over conventional burner-type systems. It is believed that by hydrogenating the coal molecule before combustion, that the build-up of unburned hydrocarbons that is found in flame combustion or coal-firing systems is substantially reduced. According to the present invention, the pulverized coal is treated in such a manner that there is no substantial development of double bond carbon elements to produce a graphite. As alluded to above, it is believed that the carbon adheres to the free hydrogen and then becomes a liquid that is later vaporized. Consequently, the ER-C 10 substantially prevents reformed hydrocarbons and graphitic formation that is characteristic of a conventional burner or flame-type system.

A bench test model was constructed and tested to demonstrate the principles of the invention with the following dimensions and operating parameters. The reactor chamber zone 14*a* has a diameter of 10.01" (25.0 cm), length 24.0" (60.0 cm), circumference 31.42" (78.54 cm), and volume $1700"^3$ (26,800 $cm^3$). The reactor core ceramic tube 84 has a diameter of 3.0" (7.5 cm), length 24.0" (60.0 cm), circumference 9.42" (23.6 cm), and volume $168.0"^3$ (2652 $cm^3$). The combustor chamber zone 16*a* has a diameter of 8.0" (20.0 cm), length 10.0" (25.0 cm), circumference 25.1" (62.8 cm), and volume $510"^3$ (8000 $cm^3$).

The ceramic baffle insert includes an array of five entropic fuel burner ducts 65, each duct having a diameter of ⅜ inches. The volumetric flow rate of methane gas through each duct 65 is 371 $ft^3/h$ (10.5 $m^3/h$). Combustion-air is communicated to the reactor core chamber 14*a* via an array of five air supply ducts 65 that are disposed around each fuel burner duct 64. Each air supply duct 65 is preferably ⅜ inches in diameter. There are a total of 25 air supply ducts 65. The volumetric flow rate of the combustion air is about 3175 $ft^3/h$ (90 $m^3/h$). The ratio of the circumferential surface area of the refractory reactor chamber zone 14*a* to the volume of the reactor chamber zone 14*a* is 1.0/2.5 (based on 4712 $cm^2$/26800 $cm^3$, or $754"^2/1700"^3$).

The mass flow rate of the pulverized coal particles dispensed into the reactor core tube 84 through the pulverized coal/gas supply passage 86 and nozzle 85 is about 80 lb/h (36 kg/h, or 10 grams/s). The volumetric flow rate of the methane gas through the passage 86 and nozzle 85 is 380 $ft^3/h$ (10.8 $m^3/h$, or 3000 $cm^3/s$). The resulting ratio of methane gas to pulverized coal is 300 $cm^3/s$ gas to 1.0 gram/s pulverized coal. A preferred diameter of the pulverized coal/gas supply passage is 1.15" (3.125 cm). The circumferential surface area of the reactor core tube 84 (based on the internal diameter) is $226"^2$ (1415 $cm^2$). The ratio of the circumferential surface area of the reactor core tube 84 to the core volume of the reactor core tube is $226"^2/168"^3$ (1415 $cm^2$/2640 $cm^3$).

The ER-C 10 includes four equally spaced radially positioned combustion air supply pipes 54 for directing air flow perpendicular to the flow of the reformulated pulverized coal/gas fuel expelled from the reactor core tube 84. Each pipe 54 has a diameter of 2.0" (5.0 cm). The combustion air flow rate through each air supply pipe 54 is about 360 $m^3/h$ (90 $m^3/h$). The venturi defined by the wall 22 of the combustion chamber refractory 16 is approximately a 25 cm:20 cm reduction in cross-sectional area. The volumetric flow rate of the pulverized coal/gas fuel mixture expelled by the nozzle 85 enters the combustor combustion chamber zone 16*a* at approximately 13,000 $cm^3/s$ (46.8 $m^3/h$).

The temperature in the reactor chamber zone 14*a* was approximately 3000–3200 degrees F. The temperature realized by the coal/gas fuel mixture in the combustion chamber zone 16*a* was approximately 2400–2600 degrees F. The temperature of the combustor chamber was about 3300–3500 degrees F. The power output realized was approximately 360,000 KCal/h (1,500,000 Btu/h).

Figure 4:
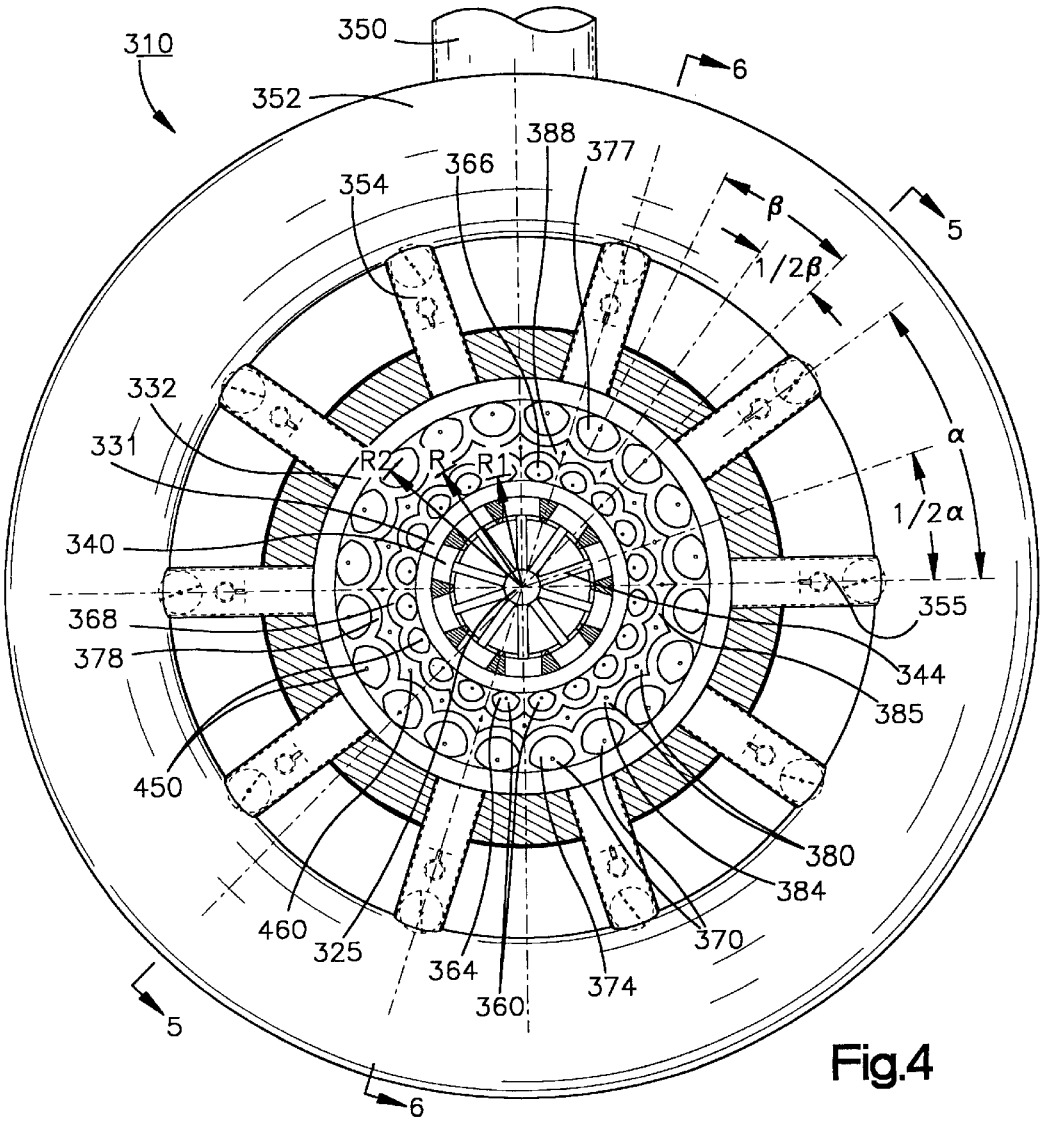
FIG. 4 is an end elevation view of an entropic reactor combustor constructed in accordance with the present invention.
Figure 5:
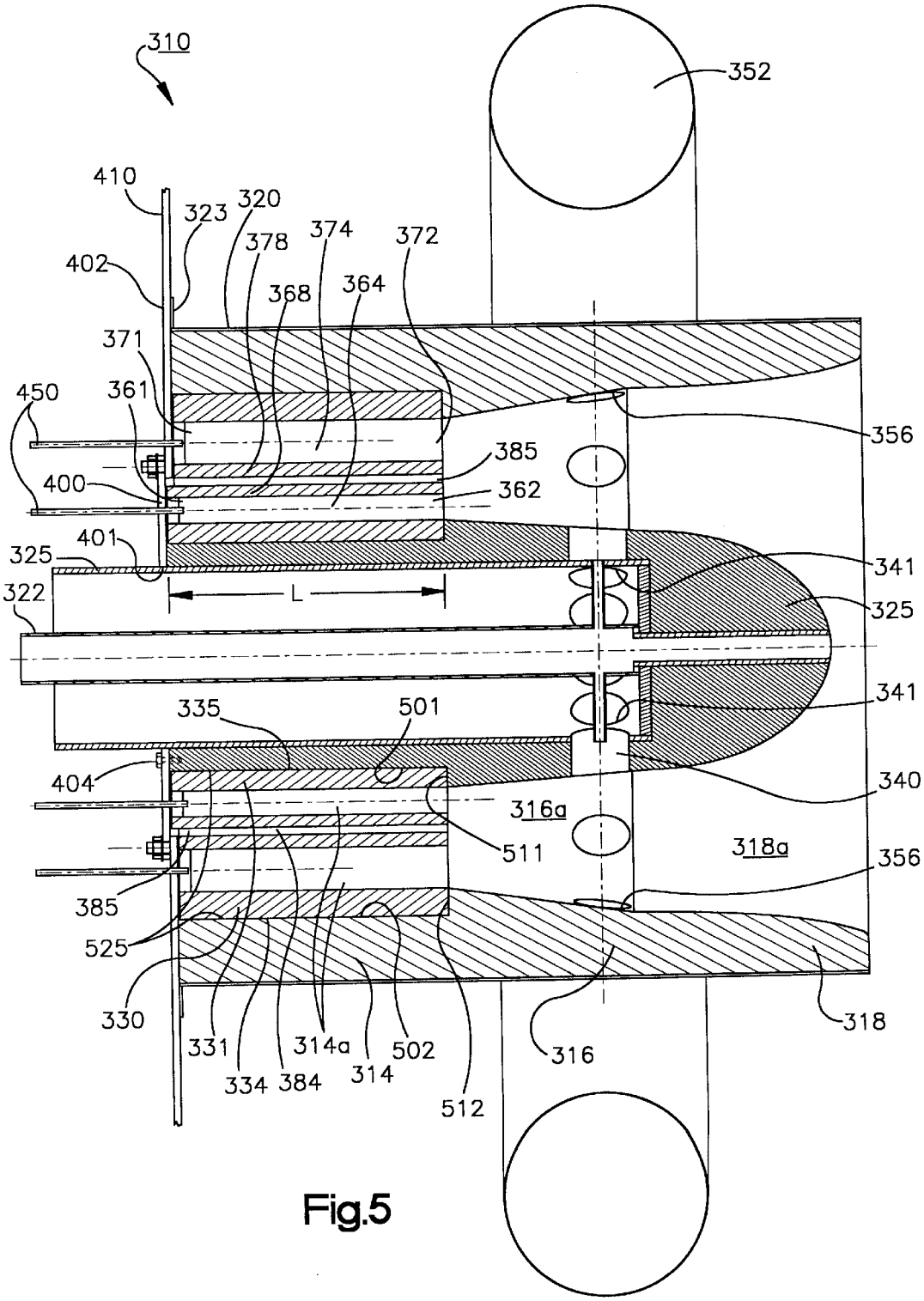
FIG. 5 is a section view of the FIG. 4 entropic reactor combustor as seen from the plane 5—5 in FIG. 4 showing first and second array ducts.
Figure 6:
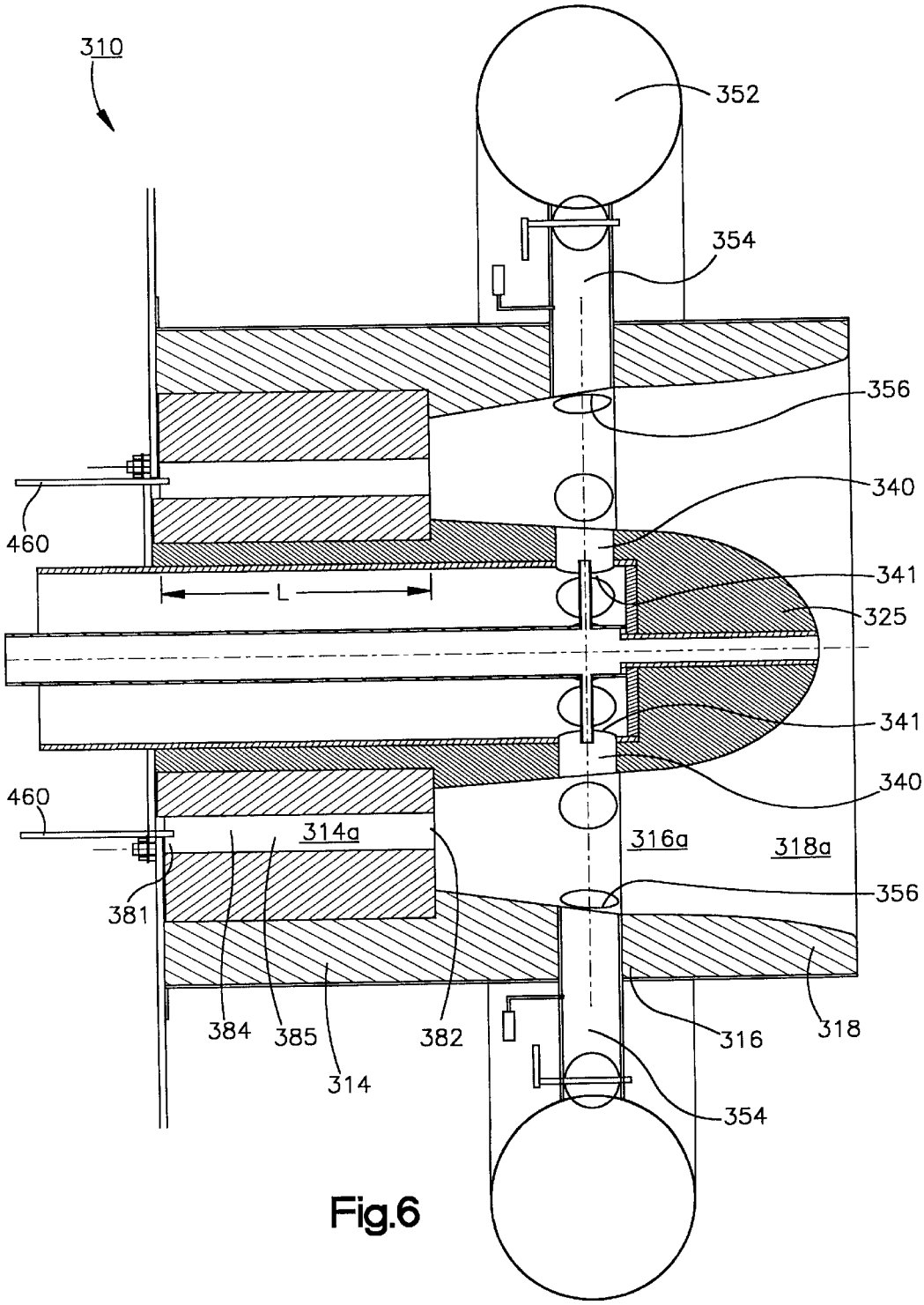
FIG. 6 is a section view of the FIG. 4 entropic reactor combustor as seen from the plane 6—6 in FIG. 4 showing an interspacial reactor chamber.

Referring now to FIGS. 4 through 6, another preferred embodiment is illustrated showing the overall construction of a "multi-cell" Entropic Reactor-Combustor (ER-C) 310 for converting chemical energy of a fossil fuel to thermal energy for use in an industrial or utility power generation plant. As shown in FIG. 5, the multi-cell ER-C 310 includes a reactor chamber refractory 314, combustion chamber refractory 316, and discharge chamber refractory 318 connected in series and encased in a combustor support housing 320 with a end plate flange 323. The chambers 314, 316, 318 define, respectively, a reactor chamber zone 314*a*, combustion chamber zone 316*a*, and discharge chamber zone 318*a*. In concentric relation to the three chambers 314, 316, 318 is an alloy tube 325 extending through the reactor chamber zone 314*a* to the entry of the combustion chamber zone 316*a* which defines an inner oxidizing media or combustion-air manifold 322 for controlling flow of oxygen or air to the combustion chamber zone 316*a*. An outer ceramic baffle insert 330 and an inner ceramic baffle insert 331 are circumferentially positioned between the alloy tube 325 and the reactor chamber 314.

In communication with the inner air manifold 322 are a plurality of radial air supply ducts 340 extending outward to openings 341 in the alloy tube 325. As shown in FIG. 4, an outer oxidizing media or combustion-air manifold 352 also has a plurality of radial air supply ducts 354 extending inward to openings 356 in the combustion chamber 316.

The inner ceramic baffle insert 331 defines an array 360 of integrated entropic fuel burner ducts 364 disposed on a first radius R1 and the outer ceramic baffle insert 330 defines an array 370 of larger entropic fuel burner ducts 374 disposed on a larger second radius R2. Between the first and second radially disposed entropic fuel ducts 364, 374 is an array 80 of configurated cells 384 disposed on an intermediate radius R. The open spaces or voids of the cells 384 form a continuous circumferential chamber, or an interspacial reactor core 385.

A generally circular baffle support flange-plate 410 is mounted to the end plate flange 323 by a plurality of bolts 402. The baffle support plate 410 is further connected to an interior baffle support plate 400 having an opening 401. The alloy tube 325 and the inner combustion-air manifold 322 extend through the opening 401 to an external air supply header (not shown).

FIG. 5 shows a section view of the ceramic entropic fuel ducts 364, 374. At their upstream end 361, 371 the ducts 364, 374 begin at the baffle support plates 400, 410 and are in communication with a plurality of entropic fuel supply nozzles 450 connected to an external fuel supply source and a combustion air ratioing device (not shown). The radially disposed ducts 364, 374 extend the length of the ceramic baffle inserts 330, 331 to outlets 362, 372, respectively, adjacent the entrance of the combustion chamber zone 316*a*.

FIG. 6 shows a section view of the array 380 of the reactor-core cells 384 which form the circumferentially configured reactor core chamber 385. At their upstream end 381 the cells 384 begin at the baffle support plates 400, 410 and are in communication with a plurality of pulverized coal/gas fuel mixture supply nozzles 460 which are connected to an external fuel flow control source (not shown). The interspacial reactor core 385 extends the length of the ceramic baffle inserts 330, 331 and terminates at a mix/ignition zone 382 located near the entrance of the combustion chamber zone 316*a*. A fossil fuel, such as pulverized coal, and a gas, such as methane, are dispensed into the interspacial reactor chamber 385 through the fuel supply nozzles 460.

In the disclosed embodiment, an entropic fuel, such as methane, and combustion air are entrained to burners and the products of combustion are routed through the first and second arrays 360, 370 of the entropic fuel ducts 364, 374. Conventional fuel burners (not shown in detail) initiate and maintain the necessary pyrolytics for the supply of heat to the multiple ducts 364, 374.

Referring to FIG. 4, the outer combustion-air manifold 352 supplies oxygen or air to a plurality of radially extending air supply ducts 354 and inward to air inlet openings 356 in the combustion chamber 316 (as shown in FIGS. 5 and 6). Combustion air is also simultaneously dispensed from the inner combustion-air manifold 322 outward to a plurality of radially extending air supply ducts 340 and air inlet openings 341 in the combustion chamber 316.

The use of a multi-cell ER-C 310 for fossil fuel provides several advantages over conventional burner-type systems. The burning process of entropic fuel in the ducts 364, 374 of the ceramic baffle inserts 330, 331 generates intense pyrolytic source heat for conduction through duct walls 368, 378 of the first and second arrays 360, 370 of the entropic fuel ducts 364, 374. The reactor chamber 385 utilizes an array 380 of unitized "cells" 384 which bound the interspacial reactor chamber 385. It is believed that the pulverized coal/gas fuel mixture, upon entry into the cells 384, undergoes a mechanical procedure to disperse and diffuse the pulverized coal/gas fuel mixture to effect a reduction to a decimated $1/10000$ of original volumetric mass.

In the preferred embodiment, the outer air supply or oxidizing media ducts 354 are equally spaced apart by an angle alpha to form a planetary spoked pattern 355. The inner air supply or oxidizing media ducts 340, which are equal in number to the outer air supply ducts 354, are also equally spaced apart by an angle alpha on a corresponding planetary spoked pattern 344. As shown in FIG. 4, the convergently spoked pattern 355 is relatively offset from the divergently spoked pattern 344 by an angle of about ½ alpha.

It is believed that the use of the radially positioned inner/outer counterflow directed air supply ducts 340, 354 in offset relation facilitates turbulence near the mix/ignition zone 382 in the combustion chamber 316 and results in diffusivity to maximize the dispersive mixing and particle distribution of the reactives, air and fuel, in the combustion chamber 316. As a result, the heated pulverized coal/gas fuel mixture, or newly created fuel mixture, is uniformly and instantly exposed to the oxidative reaction. Pyrolytics effect the reaction-kinetics for reducing the size of the pulverized coal/gas mixture within the interspacial reactor chamber 385 with the further desirable aspect that the rate-reactions will increase as the molecular weight of the pulverized coal decreases.

The combustion technology of the ER-C 310 promotes a detonative-oxidation of the newly created pulverized coal/gas fuel mixture to entropically maximize the internal energy, or electrostatic potential, of the fuel molecule. The molecular structure of the pulverized coal and methane gas relative to the induced pyrolytics by the ER-C core 385 is electronically restructured. The resultant molecular reformations effect the critical chemisms for promoting positive phase changes of the coal molecule from solid to liquid to gas.

Like the single-cell ER-C 10 disclosed hereinabove, the multi-cell ER-C 310 utilizes the aspects of photolysis. The high density radiation in the interspacial reactor chamber 385 effects a radical restructuring of the reactants (for example, pulverized coal and methane) in a period of microseconds to a higher disbanding energy level, further maximizing the thermionically/plasmionically created excitation state of photons and electrons. These reactions promote molecular decomposition, degradation, radicalization, ionization and atomization of the pulverized coal.

The rapid ion-molecular rate-reactions effected by the multi-cell ER-C 310 maximize thermoflux and specific heats beyond the limit and efficiency of any present flame-syndrome burner system. Unlike the lengthy time sequences for the combustion of fuels experienced by existing deflagration devices, the ER-C 310 develops work chamber temperatures in excess of those presently attained by any industrial or utility plant, and at a lower cost. Averted by the ER-C 310 are the formation of flame cores resulting from reformed hydrocarbons having a higher ratio of carbon to hydrogen. The present invention eliminates or substantially reduces blocking char forming chemisms.

The multi-cell ER-C 310, in combination with conventional catalytic additives, can effect chemisms to plasmionically combine sulfurous and nitrous pollutants and substantially convert them into inert stable compounds conforming to EPA mandated specifications. Eliminating this high price for emission control costs would reflect a higher profit margin for industrial or utility plant operations.

FIG. 5 shows an entropic-reactor combustor 10 incorporating the principles of the present invention. The size, shape, quantity, and configurative spacing of the entropic fuel ducts 364, 374 geometrically defines the corresponding cells 384 which structurally equate to the resultant interspacial reactor chamber 385. Most preferably, the first array 360 includes twenty equally spaced ducts 364 disposed on a radius of approximately 32.0 cm (12.5 inches) to form a planetary pattern 366. The second array 370 includes twenty equally spaced ducts 374 disposed on a radius of approximately 49.3 cm (19.4 inches) to form an outer planetary pattern 377. Disposed approximately at the center point of the ducts 364, 374 initiating near the end plate flange 323 are entropic fuel nozzles 450. In the preferred embodiment the planetary patterns 366, 377 have coincident concentric centers C and about equal angular displacements beta, where beta is approximately 18 degrees.

According to the invention, the interspacial reactor chamber 385 preferably includes an array 380 of twenty equally spaced gaps or cells 384 disposed on a radius of approximately 39.6 cm (15.4 inches) to form a circumferential planetary pattern 388. The planetary pattern 388 is offset from the planetary patterns 366, 377 by an angle of about ½ beta, or approximately 9 degrees. Disposed approximately at the center of each of the reactor chamber cells 384 are fossil fuel nozzles 160.

In the disclosed embodiment, the heat conducted through the walls 368, 378 of the ducts 364, 374 relates to the composition and thickness. A preferred thickness of approximately 30 mm (1.25 inches) would effect an optimum degree of heat transfer for effecting the requisite amount of radiant heat, or photolysis, in the interspacial reactor chamber 385.

Referring now to FIG. 5 of the preferred embodiment, it is seen that the refractory chambers 314, 316, 318 may comprise a concentrically unitized structure. The outer ceramic baffle 330 preferably comprises a generally circular insert having an external wall 334 which engages an internal wall 502 and outlet port 512 of the reactor chamber refractory 314. An internal wall 335 of the inner ceramic baffle 331 engages an external wall 501 and outlet port 511 of the alloy tube 325. The interfaces 525 may be formed with any ceramic material and bonding mortar.

As shown in FIGS. 5 and 6, the resident time of thermal exposure to the pulverized coal/gas fuel mixture developed in the reactor chamber cells 384 relates to the length L of the ceramic baffles 330, 331 and the flow velocity of the pulverized coal/gas fuel mixture. In the preferred and illustrated embodiment, the length L is approximately 60 cm (24.0 inches). The velocity of the pulverized coal/gas fuel mixture through the interspacial reactor chamber cells 385 is approximately 1.0 meter (3.3 feet) per second.

According to the invention, oxidizing media or combustion-air is introduced in the combustion chamber zone 316*a* through the inner array of air supply ducts 340 from the inner combustion-air manifold 322. Combustion-air is simultaneously introduced in the combustion chamber zone 316*a* through the outer array of air supply ducts 354 from the outer combustion air manifold 352. The relative volumetric air flows from the outer/inner manifolds 352, 322 can be about: 1.0 cubic meter (35.3 cubic feet) per second/0.66 cubic meter (23.3 cubic ft) per second.

Although the invention has been described with a certain degree of particularity it should be understood that those skilled in the art can make various changes to it without departing from the spirit or scope of the invention as hereinafter claimed.

What is claimed is:

1. A combustor method for treating and reacting pulverized coal for use in a fossil fuel burning plant, comprising:

a) providing a refractory defining a reactor core and a combustor chamber in serial communication;

b) heating said reactor core;

c) introducing a non-oxidizing gas/coal mixture into said reactor core;

d) transferring heat energy to the gas/coal mixture by photolytically heating the gas/coal mixture flowing through the reactor core such that the specific heat of the mixture is substantially raised;

e) discharging the heated gas/coal mixture from the reactor core into the combustor chamber; and f) introducing an oxidizing medium into the combustor chamber to oxidize the heated gas/coal mixture discharged by the reactor core.

2. A method for treating and combusting pulverized coal for use in a fossil fuel burning plant, comprising:

a) providing a refractory defining a reactor core tube and a combustion chamber in serial communication;

b) heating said reactor core tube;

c) introducing a non-oxidizing gas/coal mixture into said reactor core tube;

d) transferring heat energy to the gas/coal mixture such that the specific heat of the mixture is substantially raised;

e) discharging the heated gas/coal mixture from the reactor core tube into the combustion chamber; and f) introducing an oxidizing medium into the combustion chamber to oxidize the heated gas/coal mixture discharged by the reactor core tube.

3. A method for treating and combusting pulverized coal for use in a fossil fuel burning plant, comprising:

a) providing a refractory defining a reactor core tube and a combustion chamber in serial communication;

b) heating said reactor core tube;

c) introducing a methane gas/coal mixture into said reactor core tube;

d) transferring heat energy to the gas/coal mixture such that the specific heat of the mixture is substantially raised;

e) discharging the heated gas/coal mixture from the reactor core tube into the combustion chamber; and f) introducing an oxidizing medium into the combustion chamber to oxidize the heated gas/coal mixture discharged by the reactor core tube.

* * * * *